US006926495B2

(12) United States Patent
Diakunchak

(10) Patent No.: US 6,926,495 B2
(45) Date of Patent: Aug. 9, 2005

(54) TURBINE BLADE TIP CLEARANCE CONTROL DEVICE

(75) Inventor: Ihor S. Diakunchak, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/661,681

(22) Filed: Sep. 12, 2003

(65) Prior Publication Data

US 2005/0058539 A1 Mar. 17, 2005

(51) Int. Cl.[7] ..... F01D 11/18

(52) U.S. Cl. ..... 415/173.3; 415/12; 415/173.5; 415/173.6

(58) Field of Search ..... 415/173.1, 173.3, 415/173.4, 173.5, 173.6, 12, 113; 416/189, 416/192; 277/411, 412, 413, 433, 929

(56) References Cited

U.S. PATENT DOCUMENTS

| | | | | |
|---|---|---|---|---|
| 838,358 | A * | 12/1906 | Rotter | 415/173.6 |
| 2,314,289 | A * | 3/1943 | Salisbury | 415/173.6 |
| 2,459,850 | A * | 1/1949 | Stine | 415/173.4 |
| 3,756,738 | A | 9/1973 | Lee | |
| 3,867,060 | A * | 2/1975 | Huber | 415/173.5 |
| 3,982,850 | A | 9/1976 | Jenkinson | |
| 4,527,385 | A | 7/1985 | Jumelle et al. | |
| 4,557,704 | A | 12/1985 | Ito et al. | |
| 4,578,942 | A | 4/1986 | Weiler | |
| 5,098,257 | A | 3/1992 | Hultgren et al. | |
| 5,161,908 | A | 11/1992 | Yoshida et al. | |
| 5,234,318 | A * | 8/1993 | Brandon | 416/192 |
| 5,333,993 | A | 8/1994 | Stueber et al. | |
| 6,072,661 | A | 6/2000 | Schirle | |
| 6,206,378 | B1 | 3/2001 | Sakata et al. | |
| 6,350,102 | B1 * | 2/2002 | Bailey et al. | 415/173.5 |
| 6,406,256 | B1 | 6/2002 | Marx | |
| 6,463,729 | B2 | 10/2002 | Magoshi et al. | |
| 2004/0200642 | A1 * | 10/2004 | Downie et al. | 175/107 |

FOREIGN PATENT DOCUMENTS

| | | | | |
|---|---|---|---|---|
| SU | 779592 A | * | 11/1980 | 416/192 |
| SU | 1159970 A | * | 6/1985 | 415/173.6 |

* cited by examiner

*Primary Examiner*—Christopher Verdier

(57) ABSTRACT

A sealing system for reducing a gap between a tip of a shrouded turbine blade and a stationary shroud of a turbine engine. The sealing system includes one or more seal lands extending from a shrouded turbine blade toward a stationary shroud of a turbine engine. During operation of the turbine engine, the seal lands straighten and extend towards the stationary shroud of the turbine engine, thereby reducing the leakage of air past the shrouded turbine blades and increasing the efficiency of the turbine engine. The sealing system may also include one or more protrusions extending from the stationary shroud towards the tips of the shrouded turbine blades.

15 Claims, 2 Drawing Sheets

TURBINE BLADE TIP CLEARANCE CONTROL DEVICE

FIELD OF THE INVENTION

This invention is directed generally to turbine engines, and more particularly to systems for sealing gaps between shrouded blade tips and stationary shrouds in turbine engines so as to improve turbine engine efficiency by reducing leakage.

BACKGROUND

Typically, gas turbine engines are formed from a combustor positioned upstream from a turbine blade assembly. The turbine blade assembly is formed from a plurality of turbine blade stages coupled to discs that are capable of rotating about a longitudinal axis. Each turbine blade stage is formed from a plurality of blades extending radially about the circumference of the disc. Each stage is spaced apart from each other a sufficient distance to allow turbine vanes to be positioned between each stage. The turbine vanes are typically coupled to the shroud and remain stationary during operation of the turbine engine.

The tips of the turbine blades are located in close proximity to an inner surface of the shroud of the turbine engine. There typically exists a gap between the blade tips and the shroud of the turbine engine so that the blades may rotate without striking the shroud. During operation, high temperature and high pressure gases pass the turbine blades and cause the blades and disc to rotate. These gases also heat the shroud and blades and discs to which they are attached causing each to expand due to thermal expansion. After the turbine engine has been operating at full load conditions for a period of time, the components reach a maximum operating condition at which maximum thermal expansion occurs. In this state, it is desirable that the gap between the blade tips and the shroud of the turbine engine be as small as possible to limit leakage past the blade tips.

However, reducing the gap cannot be accomplished by simply positioning the components so that the gap is minimal under full load conditions because the configuration of the components forming the gap must account for emergency shutdown conditions in which the shroud, having less mass than the turbine blade and disc assembly, cools faster than the turbine blade assembly. In emergency shutdown conditions, the diameter of the shroud reduces at a faster rate than the length of the turbine blades. Therefore, unless the components have been positioned so that a sufficient gap has been established between the turbine blades and the turbine shroud under operating conditions, the turbine blades may strike the stationary shroud because the diameter of components of the shroud is reduced at a faster rate than the turbine blades. Collision of the turbine blades and the shroud often causes severe blade tip rubs and may result in damage. Thus, a need exists for a system for reducing gaps between turbine blade tips and a surrounding shroud under full load operating conditions while accounting for necessary clearance under emergency shutdown conditions.

SUMMARY OF THE INVENTION

This invention relates to a sealing system for reducing a gap between a tip of a shrouded turbine blade and a stationary shroud of a turbine engine. As a turbine engine reaches steady state operation, components of the sealing system reach their maximum expansion and reduce the size of the gap located between the blade tips and the engine shroud, thereby reducing the leakage of air past the turbine blades and increasing the efficiency of the turbine engine. In at least one embodiment, the sealing system includes a turbine blade assembly having at least one stage formed from a plurality of turbine blades.

The sealing system may also include one or more seal lands coupled to a turbine blade with an integral tip shroud and extending from a tip of the turbine blade toward a stationary shroud of the turbine engine. The seal land may be coupled to the turbine blade by sliding the seal land into a slot and by peening the seal land to keep the seal land from sliding out, by brazing the seal land onto the turbine blade shroud, or through any other appropriate connection method. The seal land may also have a curved configuration such that while the turbine engine is at rest, the seal land is curved and does not contact the shroud. The seal land may be curved such that the tip of the seal land may face into the gas flow, thereby enabling the seal land to deflect the incoming tip leakage flow upstream and thus, improve the effective sealing ability of the seal land. The seal land is adapted to straighten during operation of the turbine engine due to at least centrifugal forces such that the seal land is closer to the stationary shroud than when the turbine engine is in a resting state. In at least one embodiment, the seal land may be formed from two or more materials having different coefficients of thermal, expansion. The seal land may be formed from a first material forming an outer perimeter of the seal land and from a second material forming an inner perimeter of the seal land. The second material forming the inner perimeter may have a coefficient of thermal expansion that is greater than coefficient of thermal expansion for the first material forming the outer perimeter. When heated, the second material extends a greater distance than the first material, which causes the seal land to straighten.

The sealing system may also include one or more protrusions extending from the shroud of the turbine engine towards the tips of the turbine blades. The protrusions may extend circumferentially around the turbine blade assembly and may be positioned downstream of a seal land. In at least one embodiment, a protrusion may be positioned between two adjacent seal lands. The protrusions act as a dam to enhance the sealing ability of the sealing system.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
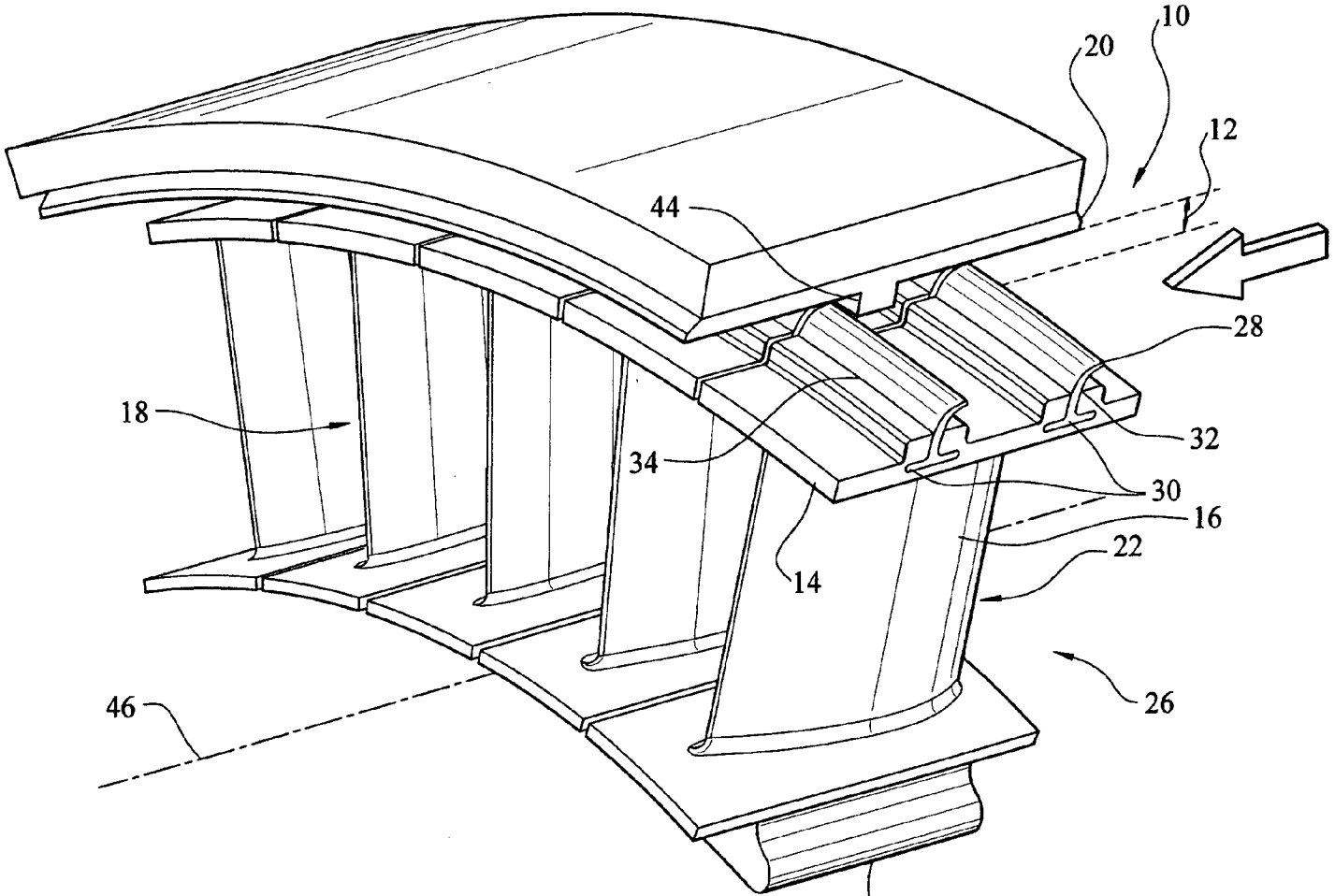
FIG. 1 is a perspective view of an embodiment of this invention.

As shown in FIGS. 1–4, this invention is directed to a sealing system 10 usable in a turbine engine. In particular, the sealing system 10 is operable to reduce a gap 12 between one or more tip shrouds 14 of a turbine blade 16 in a turbine engine 18 and a surrounding stationary shroud 20 while the turbine engine 18 is operating. The sealing system 10 reduces the gap 12 to the gap 48. The gap 48 exists in the turbine engine 18 so that the tip shrouds 14 do not contact the stationary shroud 20 while the turbine engine 18 is at rest or is operating, or during assembly. In at least one embodiment, the turbine engine 18 includes a turbine blade assembly 22 formed at least in part from a plurality of turbine blades 16 coupled to a disc 24. The blades 16 may be coupled to the disc 24 at various points along the disc 24 and may be assembled into rows, which are commonly referred to as stages 26, having adequate spacing to accommodate stationary vanes (not shown) between adjacent stages of the blades 16. The stationary vanes are typically mounted to a casing of the turbine engine 18. The disc 24 may be rotatably coupled to the turbine engine 18 enabling the turbine blades 16 to move relative to the turbine vanes. Each tip shroud 14 may extend the width of one pitch of a turbine blade segment 16. In at least one embodiment, the tip shrouds 14 may generally form a ring around the turbine blade assembly 22 having small openings at the junctions between adjacent tip shrouds 14.

The sealing system 10 may be formed from one or more seal lands 28 extending from the turbine blade 16 toward the stationary shroud 20. The seal land 28 may extend the width of the tip shroud 20 to form a relatively continuous ring around the tip shrouds 20 of the turbine blades 16 and may include spaces between adjacent seal lands 28. In at least one embodiment, the seal land 28 may have a flange 30 on bottom portion 32 for attaching the seal land 28 to the tip shroud 14 of the turbine blade 16. The seal land 28 may be inserted into a slot 34 in the tip shroud 14 of the turbine blade 16. In some embodiments, the seal land 28 is not inserted directly into the tip shroud 14 of the turbine blade 16. Instead, the seal land 28 may be attached to other portions of the turbine blade 16 in any fashion allowing the seal land 28 to extend beyond the tip shroud 14 toward the stationary shroud 20. In other embodiments, the seal land 28 may be coupled to the turbine blade 16 using brazing, welding, or other methods of mechanically fastening the seal land 28 to the turbine blade 16. Still yet, in other embodiments, the seal land 28 may be integrally formed with the turbine blade 16 in the same casting process and machined into the proper shape and configuration.

The seal land 28 may have a generally curved shape, as shown in FIGS. 1–4. The seal land 28 may be configured in this manner so that as t 18 approaches and operates at design load, the seal land 28 straightens, thereby reducing the gap 48 between the seal land 28 and the stationary shroud 20. The seal land 28 should be sized such that at rest the seal land is not in contact with the stationary shroud 20 and during steady state operation is not in contact with the stationary shroud, but is in very close proximity to reduce the gap 48 to a small distance. At rest and while the seal lands 28 are cold, the seal lands 28 should be able to be installed into the slot 34 relatively easily. The size of gap 48 in both the cold resting state and in the hot operating state depends on, in part, the rotational speed of the turbine blade 16, the length of the seal land 28, and properties of the materials forming the stationary shroud 20, the seal land 28, the turbine blade 16, and related components.

Figure 4:
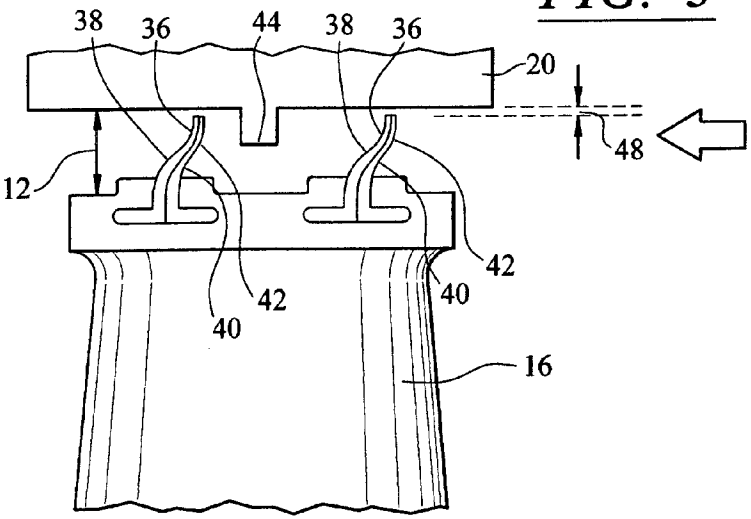
FIG. 4 is a side view of an alternative embodiment of this invention.

In at least one embodiment, the seal land 28 may be bimetallic, such as formed from two or more materials. The materials may, in at least one embodiment, have different coefficients of thermal expansion. For instance, as shown in FIG. 4, the seal land 28 may be formed from a first material 36 on the outer perimeter 38 of the seal land 28 and a second material 40 on the inner perimeter 42 of the seal land 28. The second material 40 may have a coefficient of thermal expansion that is greater than a coefficient of thermal expansion for the first material 36. In at least one embodiment, the first material 36 may be, but is not limited to, IN 909 or other appropriate materials, and the second material 40 may be, but is not limited to, A286, IN718, IN738, CM247, or other appropriate materials. As the materials heat up during operation of the turbine engine 18, centrifugal forces and the configuration of the first and second materials 36 and 40 cause the seal land 28 to straighten and reduce the distance between the seal land 28 and the stationary shroud 20. The first and second materials 36 and 40 are not limited to any particular material, except that the materials should be able to withstand the hot environment found in the turbine engine 18.

The sealing system 10 may also include one or more protrusions 44 extending from the stationary shroud 20 of the turbine engine 18 toward the tip shroud 14 of the turbine blade 16. In at least one embodiment, the stationary shroud 20 may be, but is not limited to, a honeycomb structure configured to provide little resistance to deformation should a seal land 28 or blade shroud tip 14 contact the stationary shroud 20. In the event the seal land 28 or blade shroud tip 14 contacts the stationary shroud 20, the stationary shroud 20 formed from a honeycomb configuration easily deforms to reduce the likelihood of damaging the turbine blade 16.

The protrusions 44 may be formed integrally within the stationary shroud 20 or may be attached to the stationary shroud 20 using a weld or other appropriate method of connection. In at least one embodiment, a protrusion 44 may be positioned downstream of the seal land 18. In yet another embodiment, a protrusion 44 may be attached to a stationary shroud 20 and positioned between two adjacent seal lands 28, as shown in FIGS. 1–4. Specifically, a first seal land 28 may be positioned upstream of the protrusion 44 and a second seal land 28 may be positioned downstream of the protrusion 44. The protrusion 44 should be positioned between the seal lands 28 so that the seals lands 28 do not contact the protrusions during operation or while in a resting state. The protrusion 44 may extend circumferentially around an axis of rotation 46 of the turbine blade assembly 22.

Figure 3:
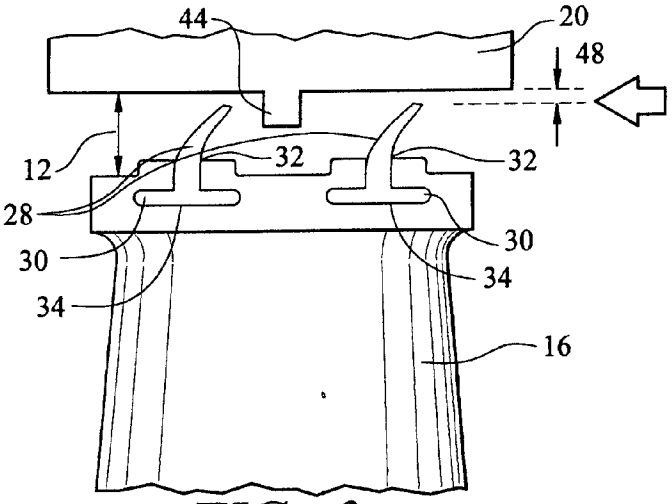
FIG. 3 is a side view of the embodiment of this invention shown in FIG. 2 and shown in FIG. 3 in an operating state of a turbine engine with the lands deflected outward.
Figure 2:
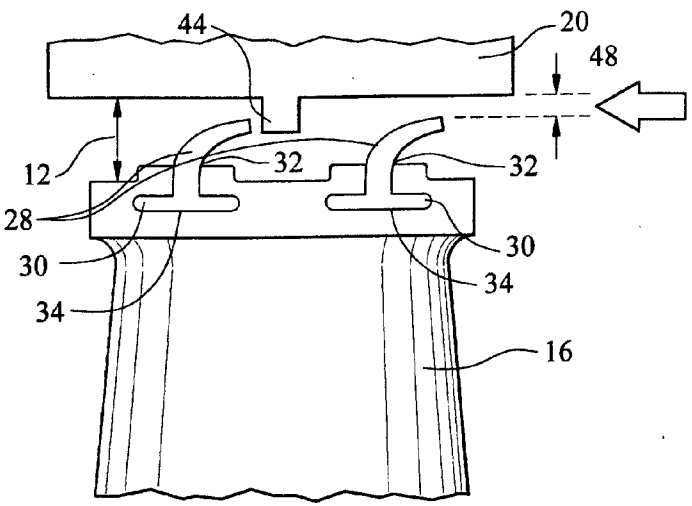
FIG. 2 is a side view of an embodiment of this invention shown in a resting state of a turbine engine.

While the turbine engine 18 is at rest, the seal land 28 is not in contact with the stationary shroud 20, as shown in FIG. 2. Rather, a gap 48 exists between the seal land 28 and the stationary shroud 20. During operation, as shown in FIG. 3, the turbine blade assembly 22 rotates relative to the turbine engine 18, and the turbine engine 18 increases in temperature. Centrifugal forces and differences in coefficients of thermal expansion cause the seal land 28 to straighten and reduce the width of the gap 48 between the seal land 28 and the stationary shroud 20. The distance that the seal land 28 extends from the tip shroud 14 of the turbine blade 16 should account for thermal expansion of the turbine blade 16 and the stationary shroud 20 so that the seal land 28 does not contact the stationary shroud 20. During emergency shutdown situations, the seal land 28 returns to its resting position and does not contact with the stationary shroud 20 in doing so. In particular, the seal land 28 cools faster than the stationary shroud 20, in part, because the seal land 28 has a larger surface area to mass ratio than the shroud. Thus, the temperature of the seal land 28 is reduced at a faster rate than the shroud, which causes the length of the seal land 28 to be reduced at a faster rate than the stationary shroud 20, thereby withdrawing the seal land 28 from the stationary shroud 20 and towards the blade tip shroud 14.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine engine having a sealing system for reducing a gap between a tip of a shrouded turbine blade and a stationary shroud of the turbine engine, comprising:

at least one shrouded turbine blade;

at least one seal land coupled to at least one shrouded turbine blade, the at least one seal land extending from a tip of the at least one shrouded turbine blade toward the stationary shroud of the turbine engine and having a curved configuration;

wherein the at least one seal land is adapted to straighten from a curved resting position to an operating position where a tip of the at least one seal land is closer to the stationary shroud of the turbine engine than when the turbine engine is in a resting position; and wherein the at least one seal land is attached to the at least one shrouded turbine blade by sliding the at least one seal land into a slot in the tip of the at least one shrouded turbine blade.

2. The turbine engine of claim 1, further comprising at least one protrusion extending from the stationary shroud toward the at least one shrouded turbine blade.

3. The turbine engine of claim 2, wherein at least one protrusion extends circumferentially about an axis of rotation of the at least one shrouded turbine blade.

4. The turbine engine of claim 2, wherein the at least one seal land comprises at least a first seal land and a second seal land, wherein the first seal land is positioned on the at least one shrouded turbine blade upstream of the at least one protrusion extending from the stationary shroud, and the second seal land is positioned on the at least one shrouded turbine blade downstream of the at least one protrusion extending from the stationary shroud.

5. The turbine engine of claim 1, wherein the at least one seal land is brazed to the tip of the at least one shrouded turbine blade.

6. The turbine engine claim 1, wherein the at least one seal land is curved into a gas flow.

7. The turbine engine of claim 1, wherein the at least one seal land is formed from a curved bi-metallic strip.

8. The turbine engine of claim 7, wherein the at least one seal land is formed from a first material having a first coefficient of thermal expansion and a second material having a second coefficient of thermal expansion greater than the first coefficient of the thermal expansion, wherein the first material forms the outer perimeter of the at least one seal land and the second material forms the inner perimeter of the at least one seal land.

9. A turbine engine having a sealing system for reducing a gap between a tip of a shrouded turbine blade and a stationary shroud of the turbine engine, comprising:

at least one shrouded turbine blade;

at least one seal land coupled to at least one shrouded turbine blade, the at least one seal land extending from a tip of the at least one shrouded turbine blade toward the station shroud of the turbine engine and having curd configuration;

wherein the at least one seal land is adapted to straighten from a curved resting position to an operating position where a tip of the at least one seal land is closer to the stationary shroud of the turbine engine than when the turbine engine is in a resting position; and wherein the at least one seal land is formed from a curved bi-metallic strip.

10. The turbine engine of claim 9, wherein the at least one seal land is formed from a first material having a first coefficient of thermal expansion and a second material having a second coefficient of thermal expansion greater than the first coefficient of the thermal expansion, wherein the first material forms the outer perimeter of the at least one seal land and the second material forms the inner perimeter of the at least one seal land.

11. The scaling system turbine engine of claim 9, further comprising at least one protrusion extending from the stationary shroud toward the at least one shrouded turbine blade.

12. The turbine engine of claim 11 wherein the at least one protrusion extends circumferentially about an axis of rotation.

13. The turbine engine of claim 11, wherein the at least one seal land comprises at least a first seal land and a second seal land, wherein the first seal land is positioned on the at least one shrouded turbine blade upstream of the at least one protrusion extending from the stationary shroud, and the second seal land is positioned on the at least one shrouded turbine blade downstream of the at least one protrusion extending from the stationary shroud.

14. The turbine engine of claim 7, wherein the at least one seal land is brazed to the tip of the at least one shrouded turbine blade.

15. The turbine engine of claim 9, wherein the at least one seal land is curved into a gas flow.

* * * * *